US006114641A

United States Patent [19]

Castonguay et al.

[11] Patent Number: 6,114,641

[45] Date of Patent: Sep. 5, 2000

[54] ROTARY CONTACT ASSEMBLY FOR HIGH AMPERE-RATED CIRCUIT BREAKERS

[75] Inventors: Roger N. Castonguay, Terryville; Randall L. Greenberg, Granby; Dave Christensen, Sandy Hook, all of Conn.

[73] Assignee: General Electric Company, Schenectady, N.Y.

[21] Appl. No.: 09/087,038

[22] Filed: May 29, 1998

[51] Int. Cl.[7] ..... H01H 3/00; H01H 9/20

[52] U.S. Cl. ..... 200/244; 200/400; 200/17 R; 218/32; 335/16

[58] Field of Search ..... 200/6 R, 11 R, 200/1 R, 17 R, 400, 401, 501, 244, 248, 287, 323, 324, 325, 336, 337, 50.01, 50.32, 50.33–50.35; 218/22, 30–33, 146; 335/16

[56] References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 3,953,811 | 4/1976 | Mostosi | 335/16 |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |

(List continued on next page.)

FOREIGN PATENT DOCUMENTS

| | | | |
|---|---|---|---|
| 897 691 | of 0000 | Belgium | H01F 00/00 |
| 819 008 | 12/1974 | Belgium . | |
| 0 061 092 | 9/1982 | European Pat. Off. | G03G 5/14 |
| 0 064 906 | 11/1982 | European Pat. Off. | H01H 71/74 |
| 0 066 486 | 12/1982 | European Pat. Off. | H01H 71/52 |
| 0 076 719 | 4/1983 | European Pat. Off. | H01H 71/74 |
| 0 117 094 | 8/1984 | European Pat. Off. | H01H 71/10 |
| 0 140 761 | 5/1985 | European Pat. Off. | H01H 71/52 |
| 0 174 904 | 3/1986 | European Pat. Off. | H01H 1/20 |
| 0 196 241 | 10/1986 | European Pat. Off. | H01H 71/00 |
| 0 224 396 | 6/1987 | European Pat. Off. | H01H 71/52 |
| 0 235 479 | 9/1987 | European Pat. Off. | H02H 3/04 |
| 0 239 460 | 9/1987 | European Pat. Off. | H01H 33/24 |
| 0 258 090 | 3/1988 | European Pat. Off. | H02H 7/22 |
| 0 264 313 | 4/1988 | European Pat. Off. | H01H 83/04 |
| 0 264 314 | 4/1988 | European Pat. Off. | H01H 83/00 |
| 0 283 189 | 9/1988 | European Pat. Off. | H02B 13/02 |
| 0 283 358 | 9/1988 | European Pat. Off. | H02H 3/10 |
| 0 291 374 | 11/1988 | European Pat. Off. | H01H 83/20 |
| 0 295 155 | 12/1988 | European Pat. Off. | H01H 83/20 |
| 0 295 158 | 12/1988 | European Pat. Off. | H01H 71/52 |
| 0 309 923 | 4/1989 | European Pat. Off. | H01H 77/10 |
| 0 313 106 | 4/1989 | European Pat. Off. | H02B 13/02 |
| 0 313 422 | 4/1989 | European Pat. Off. | H02H 1/00 |
| 0 314 540 | 5/1989 | European Pat. Off. | H01H 1/20 |
| 0 331 586 | 9/1989 | European Pat. Off. | H01H 83/20 |

(List continued on next page.)

*Primary Examiner*—Michael Friedhofer
*Attorney, Agent, or Firm*—Cantor Colburn LLP; Damian G. Wasserbauer; Carl B. Horton

[57] ABSTRACT

A circuit breaker rotary contact assembly employs a common pivot between the rotor assembly and the rotary contact arm. A pair of off-center expansion springs directly engage the rotor at one end and engage the rotary contact arm via a linkage arrangement at an opposite end thereof.

44 Claims, 6 Drawing Sheets

U.S. PATENT DOCUMENTS

| | | | |
|---|---|---|---|
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleau et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,066 | 10/1994 | Morel et al. | 200/17 |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |

| | | | |
|---|---|---|---|
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | | |
|---|---|---|---|
| 0 337 900 | 10/1989 | European Pat. Off. | H01H 71/32 |
| 0 342 133 | 11/1989 | European Pat. Off. | H01H 71/50 |
| 0 367 690 | 5/1990 | European Pat. Off. | H02H 3/04 |
| 0 371 887 | 6/1990 | European Pat. Off. | H01H 71/00 |
| 0 375 568 | 6/1990 | European Pat. Off. | H01H 71/02 |
| 0 394 144 | 10/1990 | European Pat. Off. | H01H 71/46 |
| 0 394 922 | 10/1990 | European Pat. Off. | H01H 1/20 |
| 0 399 282 | 11/1990 | European Pat. Off. | H01H 73/04 |
| 0 407 310 | 1/1991 | European Pat. Off. | H02H 3/347 |
| 0 452 230 | 10/1991 | European Pat. Off. | H01H 71/50 |
| 0 555 158 | 8/1993 | European Pat. Off. | H01H 71/52 |
| 0 567 416 | 10/1993 | European Pat. Off. | H01H 9/26 |
| 0 595 730 | 5/1994 | European Pat. Off. | H01H 71/08 |
| 0 619 591 | 10/1994 | European Pat. Off. | H01H 71/40 |
| 0 665 569 | 8/1995 | European Pat. Off. | H01H 83/22 |
| 0 700 140 | 3/1996 | European Pat. Off. | H02H 3/33 |
| 2 410 353 | 6/1979 | France | H01H 51/24 |
| 2 512 582 | 3/1983 | France | H01H 9/20 |
| 2 553 943 | 4/1985 | France | H02H 3/33 |
| 2 592 998 | 7/1987 | France | H02H 3/10 |
| 2 682 531 | 4/1993 | France | H01H 71/10 |
| 2 697 670 | 5/1994 | France | H01H 51/27 |
| 2 699 324 | 6/1994 | France | H01H 71/10 |
| 2 714 771 | 7/1995 | France | H02H 7/045 |
| 12 27 978 | 11/1966 | Germany . | |
| 30 47 360 | 6/1982 | Germany | H01H 85/20 |
| 38 02 184 | 8/1989 | Germany | H01H 3/46 |
| 38 43 277 | 6/1990 | Germany | H02H 3/08 |
| 44 19 240 | 1/1995 | Germany | H01H 9/10 |
| 1 227 978 | of 0000 | Russian Federation | G01N 3/30 |
| 2 233 155 | 1/1991 | United Kingdom | H01H 77/10 |
| 92/00598 | 1/1992 | WIPO | H01H 1/50 |
| 92/05649 | 4/1992 | WIPO | H04M 1/00 |
| 94/00901 | 1/1994 | WIPO | H02H 5/04 |

(CLOSED)

(OPEN)

ROTARY CONTACT ASSEMBLY FOR HIGH AMPERE-RATED CIRCUIT BREAKERS

BACKGROUND OF THE INVENTION

U.S. Pat. No. 4,616,198 entitled "Contact Arrangement for a Current Limiting Circuit Breaker" describes the early use of a first and second pair of circuit breaker contacts arranged in series to substantially reduce the amount of current let-through upon the occurrence of an overcurrent condition.

When the contact pairs are arranged upon one movable contact arm such as described within U.S. Pat. No. 4,910,485 entitled "Multiple Circuit Breaker with Double Break Rotary Contact", some means must be provided to insure that the opposing contact pairs exhibit the same contact pressure to reduce contact wear and erosion.

One arrangement for providing uniform contact wear is described within U.S. Pat. No. 4,649,247 entitled "Contact Assembly for Low-voltage Circuit Breakers with a Two-Ann Contact Lever". This arrangement includes an elongate slot formed perpendicular to the contact travel to provide uniform contact closure force on both pairs of contacts.

U.S. Pat. No. 5,030,804 entitled "Contact Arrangement for Electrical Switching Devices" describes providing a pair of cylindrical plates on either side of the contact arms and forming elongated slots within each of the cylindrical plates.

Other examples of circuit breakers employing rotary contacts are found in U.S. Pat. No. 5,281,776 entitled "Multipole Circuit Breaker with Single Pole Units; U.S. Pat. No. 5,310,971 entitled "Molded Case Circuit Breaker with Contact Bridge Slowed Down at the End of Repulsion Travel"; and U.S. Pat. No. 5,357,066 entitled "Operating Mechanism for a Four-Pole Circuit Breaker".

State of the art circuit breakers employing a rotary contact arrangement employ a rotor assembly and pair of powerful expansion springs to maintain contact between the rotor assembly and the rotary contact arm as well as to maintain good electrical connection between the contacts, per se. The added compression forces provided by the powerful expansion springs must be overcome when the contacts become separated by the contact "blow open" forces of magnetic repulsion that occur upon extreme overcurrent conditions within the protected circuit before the circuit breaker operating mechanism has time to respond.

One purpose of the invention is to describe a rotary contact arrangement having expansion springs arranged between the rotary assembly and the rotary contact arm that maintain good electrical connection between the contacts during quiescent operating current conditions while enhancing contact separation upon occurrence of extreme overcurrent conditions.

SUMMARY OF THE INVENTION

A circuit breaker rotary contact assembly employs a common pivot between the rotor assembly and the rotary contact arm. A pair of off-center expansion springs directly engage the rotor at one end and engage the rotary contact arm via a linkage arrangement at an opposite end thereof. Both the rotary contact arm and the rotor assembly are slotted at the points of contact with the extension springs for tolerance compensation between the rotary contact assembly components as well as to reduce contact wear and contact erosion

DESCRIPTION OF THE PREFERRED EMBODIMENT

Figure 1:
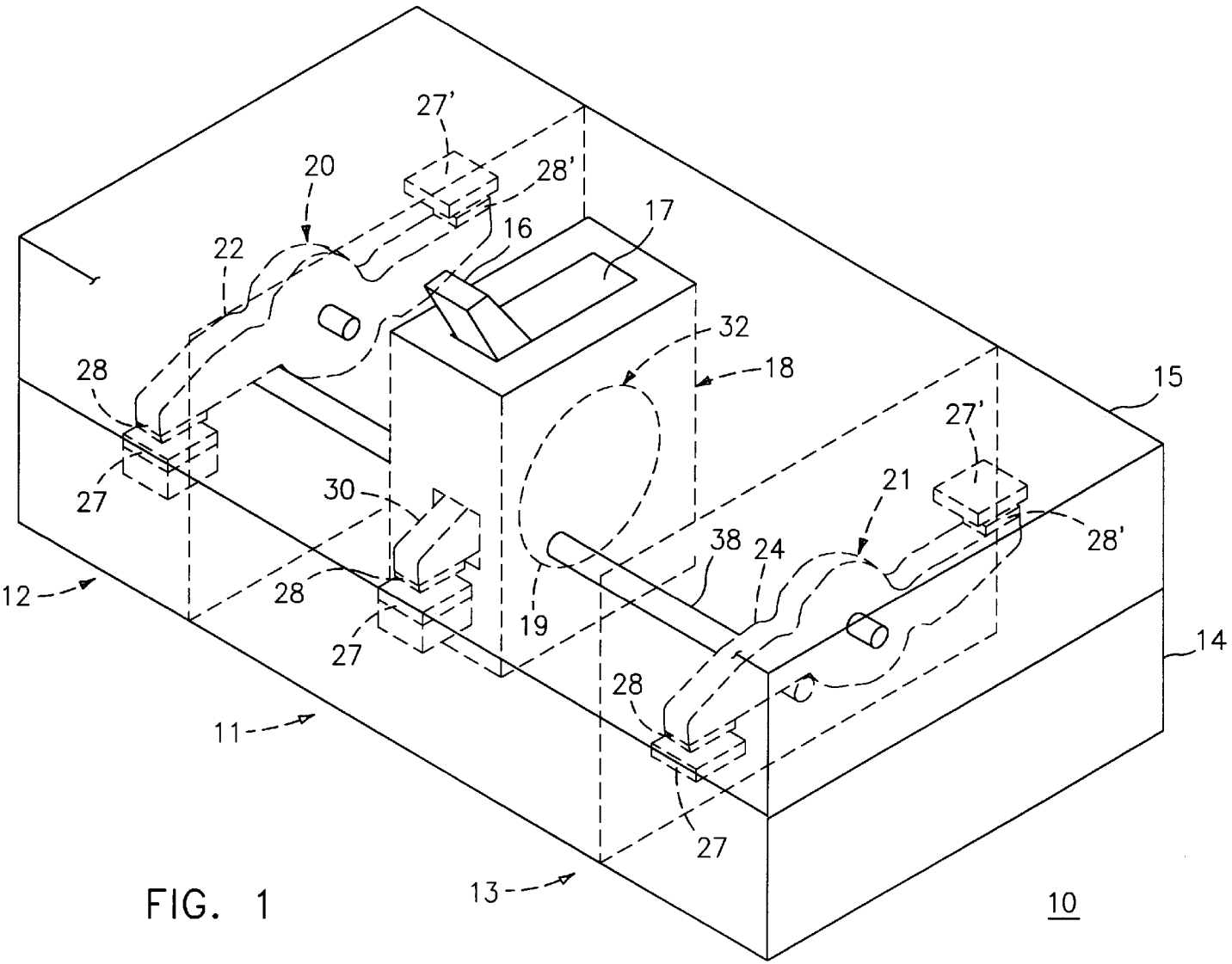
FIG. 1 is a top perspective view of a circuit breaker employing a rotary contact assembly according to the invention.

A multi-pole circuit breaker 10 is shown in FIG. 1 consisting of a case 14 and cover 15 with an operating handle 16 projecting from the cover through an aperture 17. The operating handle interacts with the circuit breaker operating mechanism 18 to control the ON and OFF positions of the central rotary contact arm 30, and central rotary contact arm assembly 32 within the circuit breaker operating mechanism. The contact arm assembly 32 being formed within the central pole 11. A first rotary contact arm 22 and first rotary contact arm assembly 20 within a first pole 12, on one side of the operating mechanism 18 within the central pole 11, and a second rotary contact arm 24 and second rotary contact arm assembly 21 within a second pole 13 on the opposite side of the central pole, move in unison to provide complete multi-pole circuit interruption. An elongated pin 38 interconnects the operating mechanism 18 with the center, first, and second rotary contact arm assemblies 32, 20, 21. As described within the aforementioned U.S. Pat. No. 4,649,247 a rotor 19 interconnects each of the rotary contact arms 22, 24, 30 with the corresponding pairs affixed contacts 27, 27' and, movable contacts 28, 28'.

Figure 2:
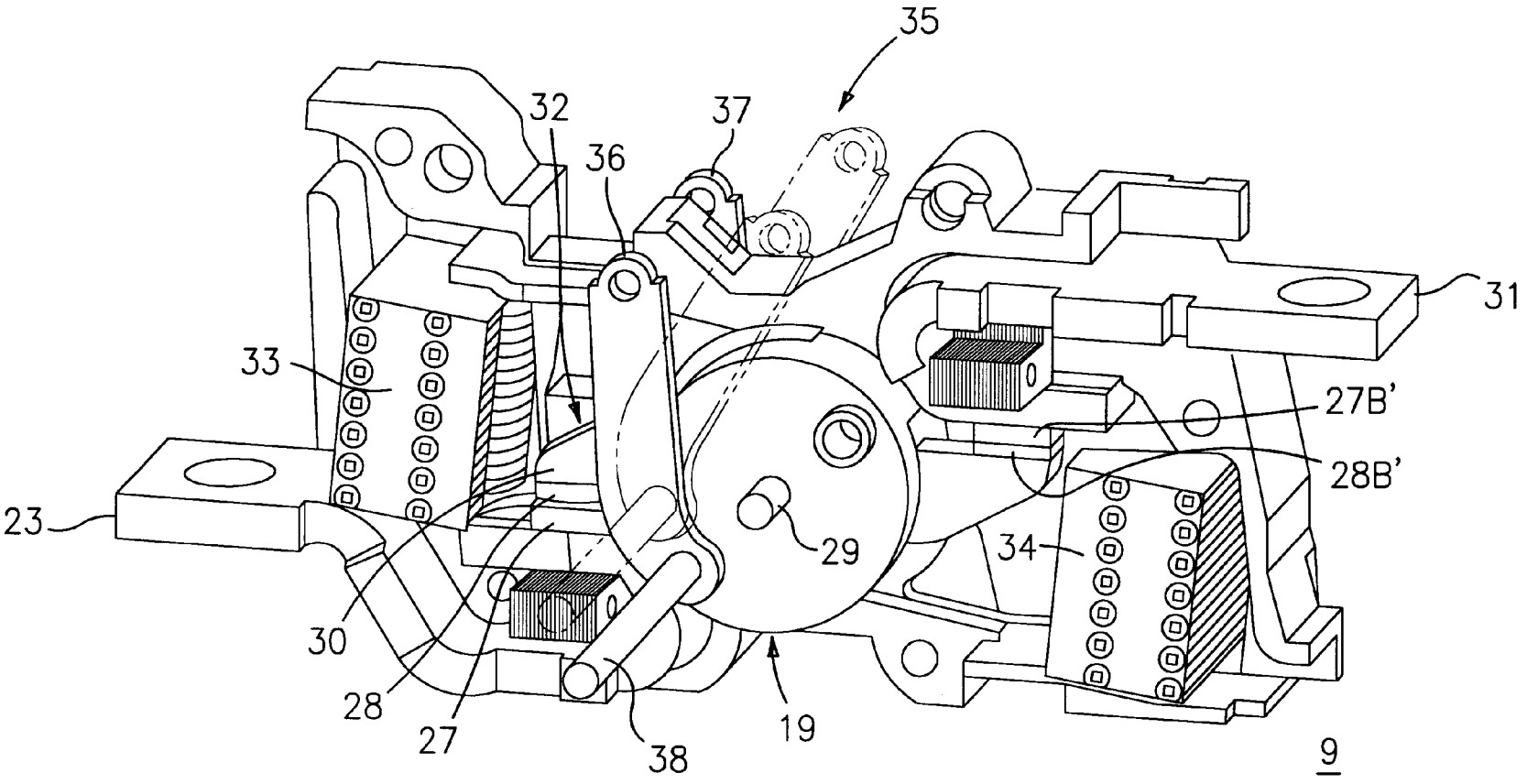
FIG. 2 is a top perspective view of the complete contact assembly contained within the circuit breaker of FIG. 1.

The rotor 19 in the circuit breaker assembly 9 is depicted FIG. 2 intermediate the line strap 23 and load strap 31 and the associated arc chutes 33, 34. The first rotary contact arm assembly 20 and second rotary contact arm assembly 21 of FIG. 1 are not shown herein but are mirror images of the central rotary contact arm assembly 32 and operate in a similar manner. The arc chutes 33, 34 are similar to that described within U.S. Pat. No. 4,375,021 entitled "Rapid Electric Arc Extinguishing Assembly in Circuit Breaking Devices Such as Electric Circuit Breakers". The central rotary contact arm 30 moves in unison with the rotor 19 that, in turn, connects with the circuit breaker operating mechanism 18 of FIG. 1 by means of the elongated pin 38 to move the movable contacts 28, 28' between the CLOSED position depicted in solid lines in FIG. 4 and the OPEN position. The clevis 35 consisting of the extending sidearms 36, 37 attach the rotor 19 with the circuit breaker operating mechanism 18 and the operating handle 16 of FIG. 1 to allow both automatic as well as manual intervention for opening and closing the circuit breaker contacts 27, 27' and 28, 28'. The rotor 19 is positioned between the line and load straps 23, 31 along with one of the contact pairs 27, 28; 27', 28' to hold the contacts in close abutment to promote electrical transfer between the fixed and moveable contacts during quiescent circuit current conditions. The operating pivot pin 29 of the central rotary contact arm 30 extends through the rotor 19 and responds to the rotational movement of the rotor to effect the contact closing and opening function in the manner described within the Italian Patent Application (75IT100)

entitled "Rotary Contact Assembly for High Ampere-Rated Circuit Breakers".

Figure 3:
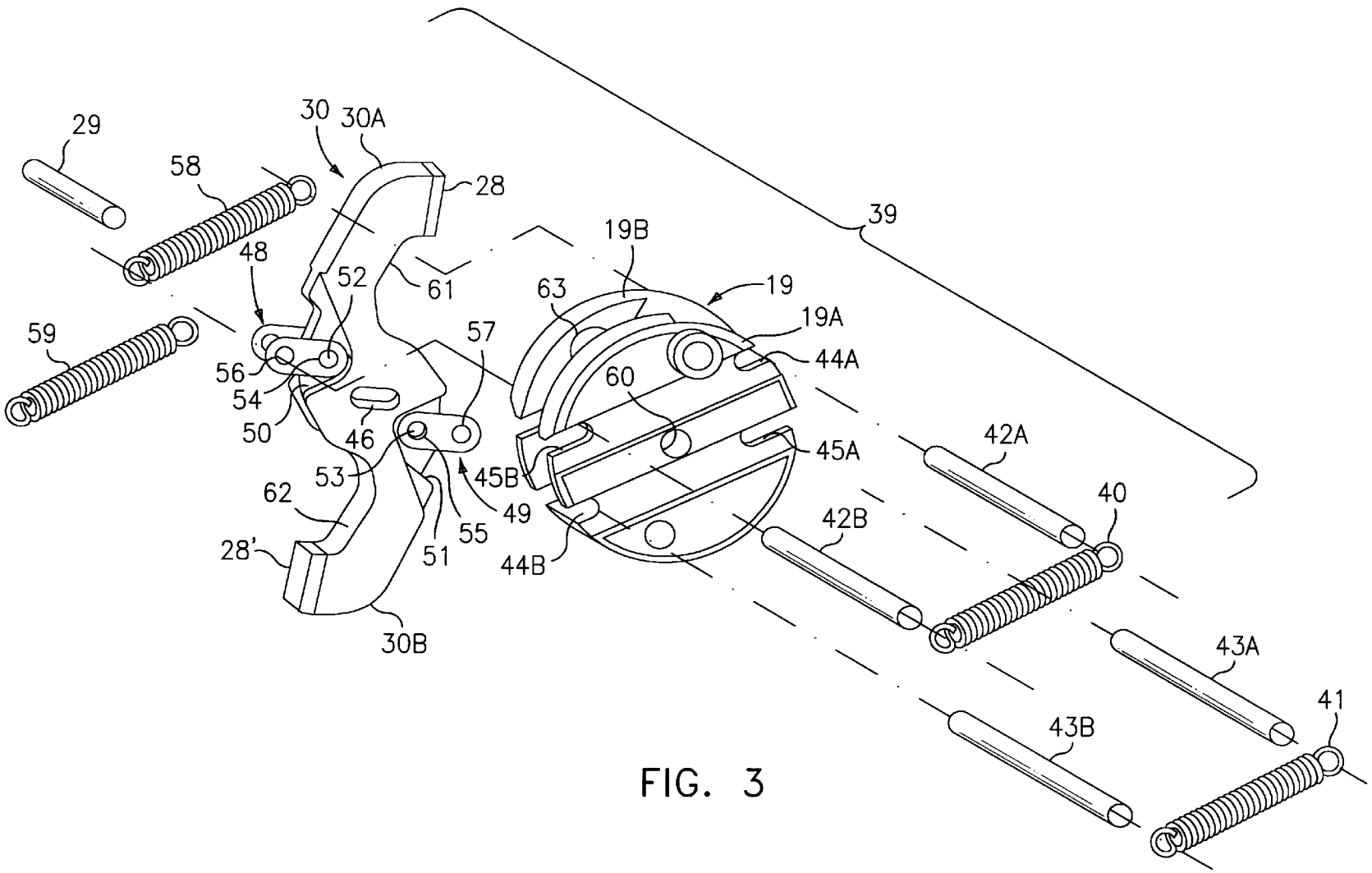
FIG. 3 is a an enlarged top perspective view of the rotor in isometric projection with the contact arm assembly of FIG. 2.

In accordance with the teachings of the invention, a hinged attachment between the slotted rotor surfaces 19A, 19B arranged on opposite sides of the slotted movable contact arm 30 within the rotor assembly 39 as now shown in FIG. 3 provides for automatic tolerance compensation between the slotted rotors and the slotted movable contact arms within all three poles 11–13 of the circuit breaker 10 of FIG. 1. The slotted contact arm 30 includes a slotted pivot aperture 46 for receiving the pivot pin 29 and a pair of top and bottom links 48, 49 attached to the slotted movable contact arm by means of pins 52, 53 and apertures 54, 55 arranged within the V-shaped slots 50, 51. The slotted rotor 19 defines a pair of outer surfaces 19A, 19B each include central apertures, one of which is shown at 60 for receiving the pivot pin 29, along with opposing shallow slots 44A, 44B and opposing deep slots 45A, 45B, as indicated. A first expansion spring 40 is attached to the slotted rotors by means of first pins 42A, 42B. The slotted contact arm 30 is inserted within the slot 63 formed within the slotted rotor intermediate the rotor outer surfaces 19A, 19B. The first pin 42A extends through the shallow slot 44A and the second pin 42B extends through the deep slot 45B. The first pin 42A extends under the surface 61 defined under the movable contact 30A and then through one end of an opposing expansion spring 58 on the rotor outer surface 19B. The second pin 42B extends through the deep slot 45B, through the aperture 56 in the top link 48, and then through the other end of the expansion spring 58 on the rotor outer surface 19B. A second expansion spring 41 is attached to the slotted rotor by means of second pins 43A, 43B. The second pin 43A extends through the deep slot 45A, through the aperture 57 in the bottom link 49, and then through one end of an opposing expansion spring 59 on the rotor outer surface 19B. The second pin 43B extends through the shallow slot 44B, over the surface 62 defined on the movable contact arm 30B and then through the other end of the expansion spring 59 on the rotor outer surface 19B.

Figure 4:
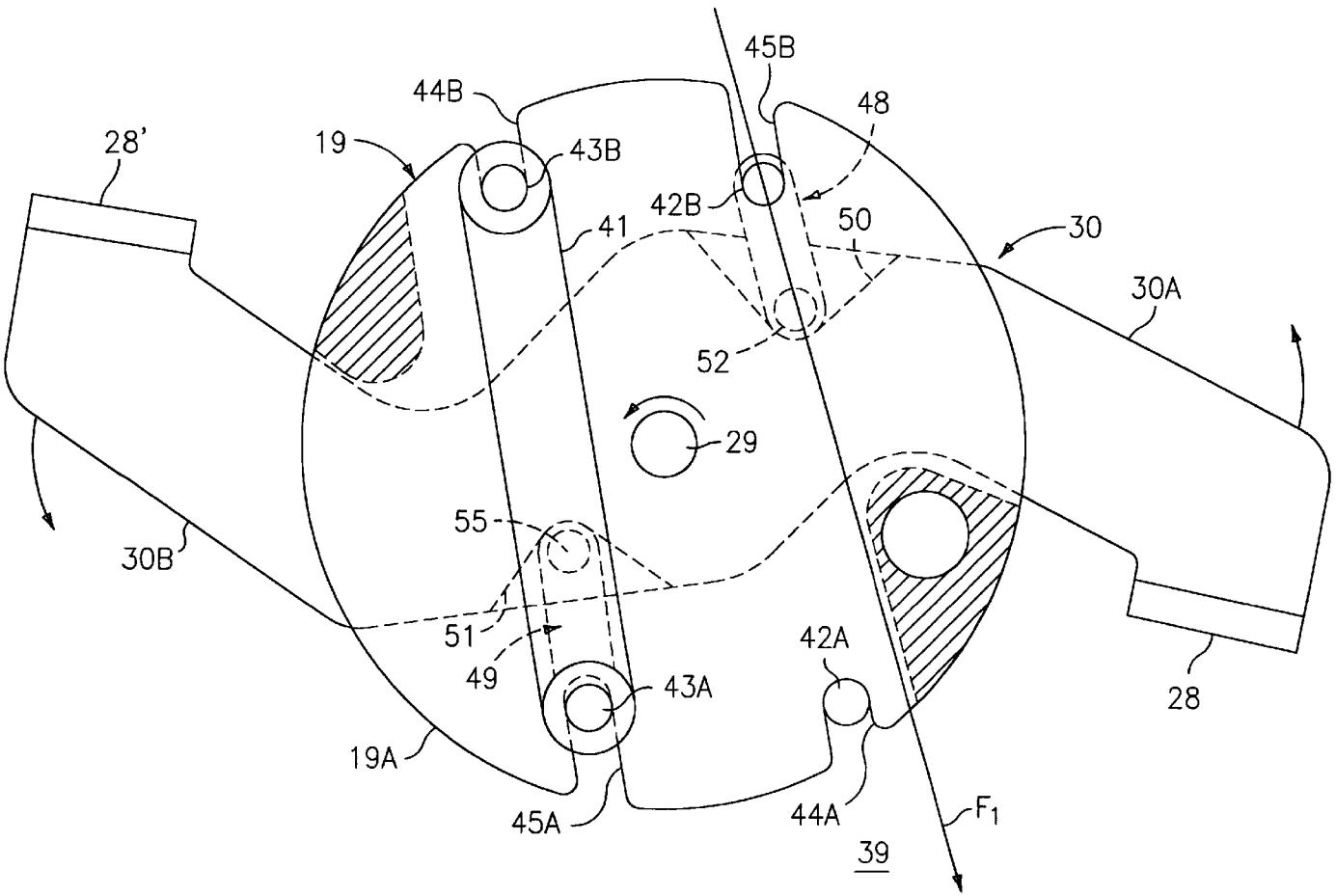
FIG. 4 is an enlarged front plan view of the rotary contact arm assembly according to the invention with the contacts in the CLOSED position.

The slotted rotor assembly 39 is depicted in FIG. 4 with the movable contacts 28, 28' on the opposite ends of the contact arms 30A, 30B in the CLOSED condition relative to the fixed contacts 27, 27' (shown in FIG. 1). The top and bottom links 48, 49 are arranged on the top and bottom parts of the slotted contact arm 30 within the V-shaped slots 50, 51 and within the associated slots 45A, 45B on the slotted rotor 19 as viewed from the rotor surface 19A. The expansion spring 41 is shown arranged between the pins 43A, 43B and the expansion spring 40 between the pin 42B in the top link 48 and the pin 42A is omitted to show the positional relationship between the line of force $F_1$ directed through the pins 42B, 52 in the top link 48. This arrangement provides optimum contact pressure between the movable and fixed contacts 28, 27, 28', 27' while allowing for contact wear compensation and tolerance adjustment between the components within the rotor assemblies 39 within the individual poles within the circuit breaker of FIG. 1.

Figure 5:
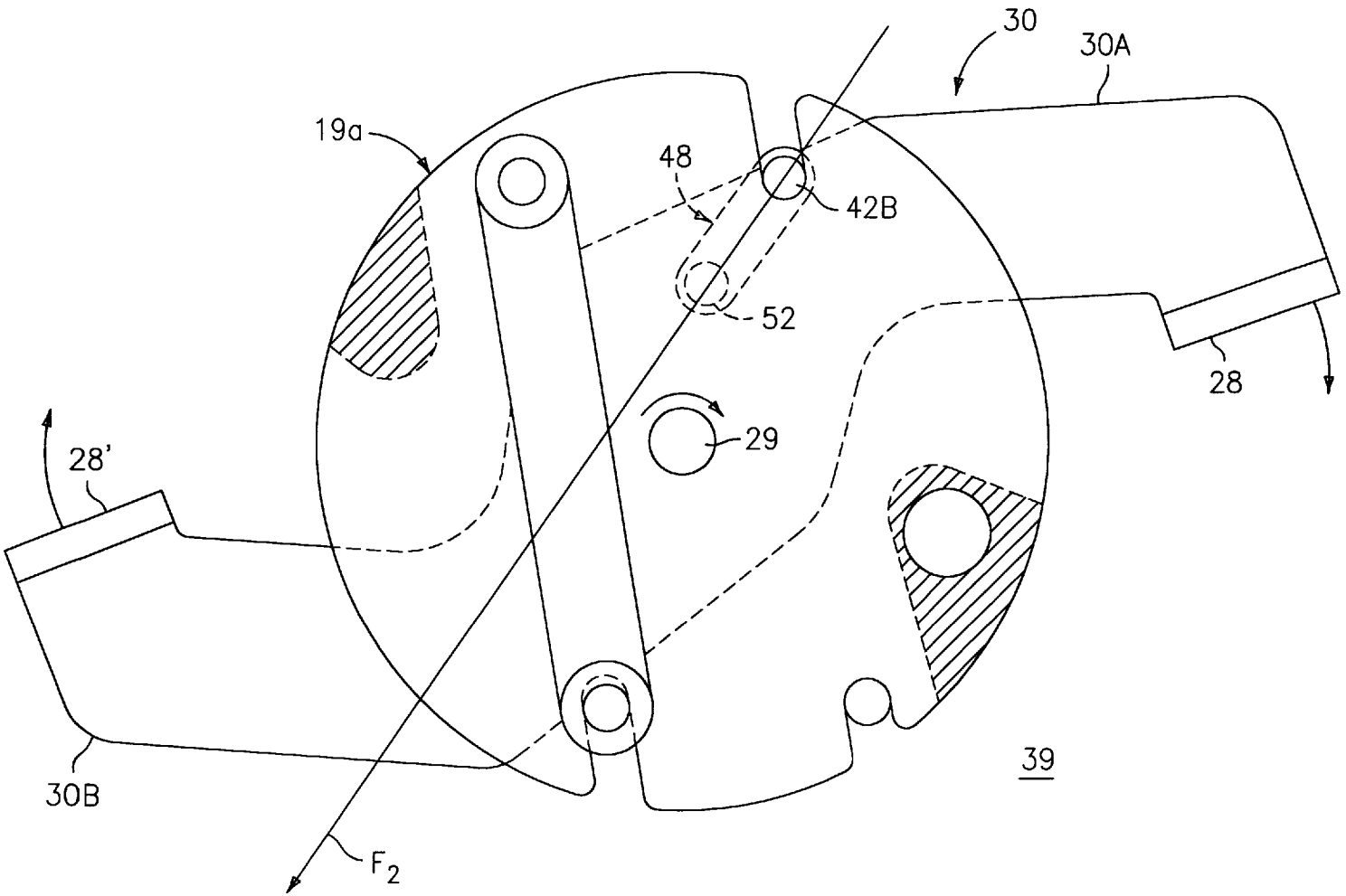
FIG. 5 is an enlarged front plan view of the rotary contact arm assembly according to the invention with the contacts in the OPEN position.

Upon occurrence of a large overcurrent condition within the circuit breaker assembly of FIG. 2 containing the slotted rotor assembly 39 of FIG. 5, the magnetic repulsion forces generated between the movable and fixed contacts 28, 27, 27' (shown in FIG. 1) within the circuit breaker assembly drive the movable contact arms 30A, 30B and the associated movable contacts 28, 28' in the counterclockwise direction about the pivot pin 29 to the OPEN position shown in FIG. 5. The rotation of the upper link 48 moves the link pin 52 to the position indicated in FIG. 5 such that the line of force exerted by the expansion springs 40, 41 (FIG. 3) is now directed through the pins 42B, 52 in the top link 48 as indicated at $F_2$, locking the slotted contact arm 30 in the OPEN position to prevent re-closure of associated the movable and fixed contacts 28, 27, 28', 27' until the circuit breaker operating mechanism 18 shown in FIG. 1 has responded to separate the movable and fixed contacts 28, 27, 28', 27' within each of the circuit breaker poles 11–13 . Upon movement of the circuit breaker operating handle 16 to reset the circuit breaker operating mechanism, the slotted contact arm 30 rotates in the clockwise direction about the pivot 29 to return the contact arms 30A, 30B to the CLOSED position shown in FIG. 4. It has been determined that the automatic expansion and contraction of the springs 40, 41,58, 59, the top and bottom links 48, 49 and the provision of the slots 44A, 44B, 45A, 45B of FIG. 3 results in the best tolerance adjustment between the rotor assembly 39 than has ever heretofore been attainable in so-called rotary contact arrangements with self locking contact arm capabilities within circuit breakers.

U.S. Pat. No. 4,616,198 entitled "Contact Arrangement for a Current Limiting Circuit Breaker" describes a circuit interruption arrangement having a single pair of fixed and movable contacts that become separated by rotation of a single contact arm to which the movable contact is attached at one end.

Figure 6:
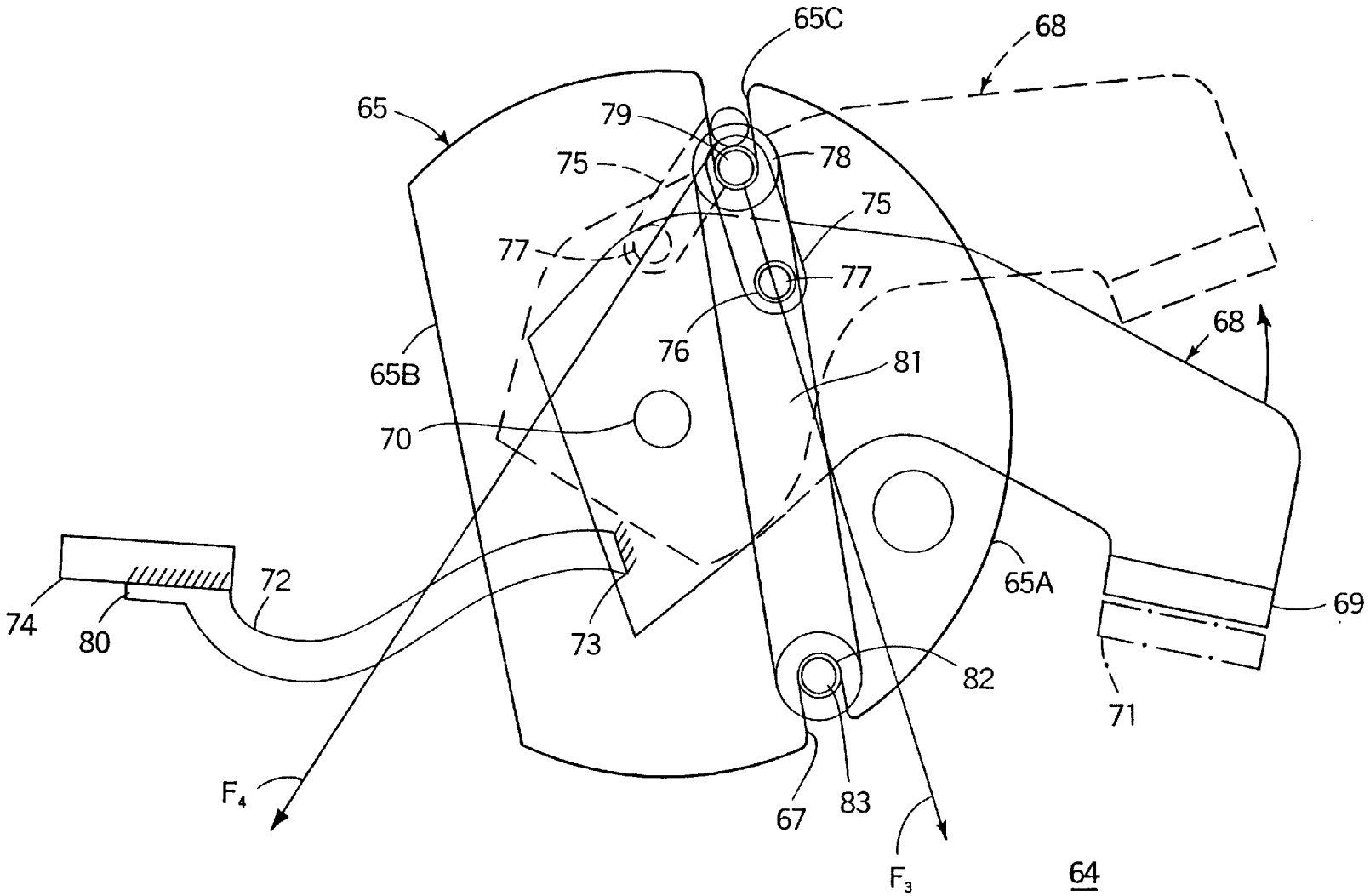
FIG. 6 is an alternate embodiment of the rotary contact arm assembly according to the invention.

In further accordance with the teachings of the invention, a semi-rotor assembly 64 is depicted in FIG. 6 to include a semi-rotor 65 having a circular forward surface as indicated at 65A and a planar rear surface as indicated at 65B. The movable contact 69 is positioned at one end of the contact arm and the pivot pin 70 attaches the contact arm to the semi-rotor 65 at the opposite end thereof. A contact braid 72 is fixedly attached to the movable contact arm as indicated at 73 at one end, and to the load strap 74 at the opposite end as indicated at 80. In a similar manner as described with respect to FIGS. 3–5, a link 75 connects with the contact arm 68 at one end by means of the pin 77 and is positioned within the slot 65C within the semi-rotor 65 and is retained therein by means of the extended pin 79. A similar expansion spring 81 extends between the pin 79 at one end of the expansion spring as indicated at 78 and the extended pin 82 within the slot 67 at the opposite end of the expansion spring as indicated at 83. An opposing expansion spring (not shown) extends between the pin 79 and the extended pin 82 on the other side of the semi-rotor assembly 64. The link 75 is arranged such that the force line $F_3$ exhibited by the expansion spring between the semi-rotor and the contact arm is directed along the link pins 77, 79 resulting in the maximum contact pressure exhibited between the movable and fixed contacts 69, 71 when the contacts are in the CLOSED position indicated in solid lines. Upon occurrence of a large overcurrent condition within the circuit breaker assembly of FIG. 2 containing the semi-rotor assembly 64 of FIG. 6, the magnetic repulsion forces generated between the movable and fixed contacts 69, 71 within the circuit breaker assembly drive the movable contact arm 68 and the associated movable contact 69 in the counterclockwise direction about the pivot pin 70 to the OPEN position indicated in dashed lines. The force line $F_4$ exhibited by the expansion spring between the semi-rotor and the contact arm is now directed along the link pins 77, 79 in such a manner that the movable contact arm 68 is locked in the in the OPEN position to prevent re-closure of associated the movable and fixed contacts 69, 71 until the circuit breaker operating mechanism 18 shown in FIG. 1 has responded to separate the movable and fixed contacts 28, 27 within each of the circuit breaker poles 11–13. Upon movement of the circuit breaker operating handle 16 to reset the circuit breaker operating mechanism, the movable contact arm 68 rotates in the clockwise indicate direction about the pivot 70 to return the contact 69 to the CLOSED position in the manner described earlier.

The provision of a link connection between a rotor assembly and a movable contact arm has been shown herein to improve performance of a circuit breaker during contact separation as well as contact closure. The arrangement of at least one expansion spring between the link and the associated rotor provides optimum contact force by compensating for component tolerance and contact erosion and wear while still maintaining a reliable means for locking the contact arm 30 open in the event of an over current condition.

What is claimed is:

1. A circuit breaker moveable contact assembly comprising:

a circular rotor having a rotor aperture through a central portion thereof;

a moveable contact arm having a moveable contact arranged on opposite ends and a contact aperture through a central portion thereof;

a pivot pin extending through said rotor aperture and said contact aperture for allowing rotation of said movable contact arm with respect to said rotor; and a first linkage having a first end and a second end, for preventing re-closure of the movable contact with a fixed contact, pivotally attached to said contact arm at first end and to said rotor at the second end for connecting said contact arm to said rotor.

2. The contact assembly of claim 1 including a second linkage having a first end and a second end, pivotally attached to said contact arm at first end and to said rotor at the second end for connecting said contact arm to said rotor.

3. The contact assembly of claim 2 wherein said contact arm includes a second V-shaped slot on said opposite end, said second linkage being positioned within said second V-shaped slot.

4. The contact assembly of claim 2 further including:

a first pair of pins engaging said rotor, one of said first pair of pins further engaging said first linkage for attaching said contact arm to said rotor;

a first spring secured between said first pair of pins;

a second pair of pins engaging said rotor, one of said second pair of pins further engaging said second linkage for attaching said contact arm to said rotor; and a second spring secured between said second pair of pins.

5. The contact assembly of claim 4 wherein one of said first pair of pins is disposed in a first slot in said rotor, and one of said second pair of pins is disposed in a second slot in said rotor.

6. The contact assembly of claim 1 further including a first spring on a one side of said rotor and a first pair of pins attaching said contact arm to said rotor on said one side.

7. The contact assembly of claim 6 further including a second spring on a opposite side of said rotor, said first pair of pins attaching said contact arm to said rotor on said opposite side.

8. The contact assembly of claim 7 including a third spring on said one side of said rotor and a second pair of pins attaching said contact arm to said rotor on said one side.

9. The contact assembly of claim 8 including fourth spring on said opposite side of said rotor, said second pair of pins attaching said contact arm to said rotor on said opposite side.

10. The contact assembly of claim 8 wherein one of said second pair of pins further extends through said second linkage.

11. The contact assembly of claim 8 wherein said second pair of pins are disposed in a first pair of opposing slots in said rotor.

12. The contact assembly of claim 11 wherein said first pair of pins are disposed in a second pair of opposing slots in said rotor, one of said first pair of opposing slots extends further than the other of said first pair of opposing slots, and one of said second pair of opposing slots extends further than the other of said second pair of opposing slots.

13. The contact assembly of claim 6 wherein one of said first pair of pins further extends through said first linkage.

14. The contact assembly of claim 6 wherein said first pair of pins are disposed in a first pair of opposing slots in said rotor.

15. The contact assembly of claim 14 wherein one of said first pair of opposing slots extends further than the other of said first pair of opposing slots.

16. The contact assembly of claim 1 wherein said contact arm includes a first V-shaped slot on said one end, said first linkage being positioned within said first V-shaped slot.

17. A circuit breaker movable contact assembly comprising:

a rotor having first and second slots formed thereon, a movable contact arm having a movable contact at one end arranged for moving in and out of contact with a fixed contact and a pivot at an opposite end, said pivot being movable attached to said rotor;

a linkage having a first end and a second end, for preventing re-closure of the movable contact with a fixed contact, attached to a top part of said movable contact arm at the first end and having the second end attached to a first pin arranged in said first slot within said rotor; and an expansion spring extending between said first and second slots, said spring being attached to said first pin at one end and to a second pin within said second slot at an opposite end thereof.

18. The movable contact assembly of claim 17 further including a contact braid connecting between said contact arm and a load strap.

19. The movable contact assembly of claim 17 wherein said expansion spring exerts a first force between said contact arm and said rotor defining a first line of force parallel with said linkage on one side of said pivot when said movable contact is in contact with said fixed contact.

20. The movable contact assembly of claim 19 wherein said rotor defines a circular surface on a front part and a planar surface on a rear part thereof.

21. The movable contact assembly of claim 19 wherein said first slot extends further than said second slot.

22. The movable contact assembly of claim 17 wherein said expansion spring exerts a second force between said contact arm and said rotor defining a second line of force parallel with said linkage on another side of said pivot when said movable contact is out of contact with said fixed contact.

23. A circuit breaker comprising:

a case and a cover;

a rotor assembly within said case interconnecting with an operating mechanism and a movable contact arm having a first contact at one end and a second contact at an opposite end thereof, said first movable contact being arranged for moving in and out of contact with a corresponding first fixed contact and said second movable contact being arranged for moving in and out of contact with a corresponding fixed second contact;

said rotor assembly including a circular rotor having a rotor aperture through a central portion thereof;

a moveable contact arm having a moveable contact arranged on opposite ends and a contact aperture through a central portion thereof;

a pivot pin extending through said rotor aperture and said contact aperture for allowing rotation of said movable contact arm with respect to said rotor; and a first linkage having a first end and a second end, for preventing re-closure of the movable contact with a fixed contact, pivotally attached to said contact arm at the first end and to said rotor at the second end for connecting said contact arm to said rotor.

24. The circuit breaker of claim 23 wherein said pivot pin movably attaches said rotor to said case.

25. The circuit breaker of claim 24 including a second linkage having a first end and a second end pivotally attached to said contact arm at the first end and to said rotor at the second end for connecting said contact arm to said rotor.

26. The circuit breaker of claim 25 wherein said contact arm includes a second V-shaped slot couple to said second end, said second linkage being positioned within said second V-shaped slot.

27. The circuit breaker of claim 23 further including a first spring on a one side of said rotor and a first pair of pins attaching said contact arm to said rotor on said one side.

28. The circuit breaker of claim 27 further including a second spring on said an opposite side of said rotor, said first pair of pins attaching said contact arm to said rotor on said opposite side.

29. The circuit breaker of claim 28 including a third spring on said one side of said rotor and a second pair of pins attaching said contact arm to said rotor on said one side.

30. The circuit breaker of claim 29 including fourth spring on said opposite side of said rotor, said second pair of pins attaching said contact arm to said rotor on said opposite side.

31. The circuit breaker of claim 29 wherein one of said second pair of pins further extends through said second linkage.

32. The circuit breaker of claim 29 wherein said second pair of pins are disposed in a first pair of opposing slots in said rotor.

33. The contact assembly of claim 32 wherein said first pair of pins are disposed in a second pair of opposing slots in said rotor, one of said first pair of opposing slots extends further than the other of said first pair of opposing slots, and one of said second pair of opposing slots extends further than the other of said second pair of opposing slots.

34. The circuit breaker of claim 27 wherein one of said first pair of pins further extends through said first linkage.

35. The circuit breaker of claim 27 wherein said first pair of pins are disposed in a first pair of opposing slots in said rotor.

36. The contact assembly of claim 35 wherein one of said first pair of opposing slots extends further than the other of said first pair of opposing slots.

37. The circuit breaker of claim 23 wherein said contact arm includes a first V-shaped slot coupled to said first end, said first linkage being positioned within said first V-shaped slot.

38. A circuit breaker comprising:

a case and a cover;

a rotor assembly within said case interconnecting with an operating mechanism and a movable contact arm having a movable contact at one end thereof and a pivot at an opposite end, said pivot being movable attached to said rotor, said movable contact being arranged for moving in and out of contact with a corresponding fixed contact, said rotor including a first and second slot on opposing perimeters;

a linkage having a first end and a second end, for preventing re-closure of the movable contact with a fixed contact, attached to a top part of said movable contact arm at the first end and having the second end attached to a first pin arranged in said first slot within said rotor; and an expansion spring extending between said first and second slots, said spring being attached to said first pin at one end and to a second pin within said second slot at an opposite end thereof.

39. The circuit breaker of claim 38 wherein said pivot moveably attaches said rotor to said case.

40. The circuit breaker of claim 38 further including a contact braid connecting between said contact arm and a load strap.

41. The circuit breaker of claim 38 wherein said expansion spring exerts a first force between said contact arm and said rotor defining a first line of force parallel with said linkage when said movable contact is in contact with said fixed contact.

42. The circuit breaker of claim 38 wherein said expansion spring exerts a second force between said contact arm and said rotor defining a second line of force parallel with said linkage when said movable contact is out of contact with said fixed contact.

43. The circuit breaker of claim 38 wherein said rotor defines a circular surface on a front part and a planar surface on a rear part thereof.

44. The circuit breaker of claim 38 wherein said first slot extends further than said second slot.

* * * * *